US008631675B2

(12) United States Patent
Gosmann

(10) Patent No.: US 8,631,675 B2
(45) Date of Patent: Jan. 21, 2014

(54) METHOD AND APPARATUS FOR FORMING FLANGES DURING HOT-FORMING

(75) Inventor: Stefan Gosmann, Bad Wünneberg (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 419 days.

(21) Appl. No.: 12/960,622

(22) Filed: Dec. 6, 2010

(65) Prior Publication Data

US 2011/0296892 A1 Dec. 8, 2011

(30) Foreign Application Priority Data

Dec. 4, 2009 (DE) ..... 10 2009 056 728

(51) Int. Cl.
*B21D 37/16* (2006.01)

(52) U.S. Cl.
USPC ..... 72/342.3; 72/383; 72/384

(58) Field of Classification Search
USPC ..... 72/342.3, 342.5, 342.6, 347, 379.2, 72/380, 381, 382, 383, 384, 394
See application file for complete search history.

(56) References Cited

U.S. PATENT DOCUMENTS

| | | | | | |
|---|---|---|---|---|---|
| 4,356,717 | A | * | 11/1982 | Okunishi et al. | 72/342.3 |
| 5,253,502 | A | * | 10/1993 | Poletti | 72/213 |
| 5,465,600 | A | * | 11/1995 | Goff et al. | 72/309 |
| 6,742,374 | B2 | * | 6/2004 | Ozawa | 72/342.5 |
| 2003/0025353 | A1 | | 2/2003 | Gosmann | |
| 2003/0046814 | A1 | | 3/2003 | Knaup et al. | |
| 2003/0163920 | A1 | | 9/2003 | Gehringhoff et al. | |
| 2009/0101249 | A1 | | 4/2009 | Gosmann et al. | |

FOREIGN PATENT DOCUMENTS

| | | | | |
|---|---|---|---|---|
| DE | 1 452 564 | | 5/1969 | |
| DE | 10247301 | | 4/2004 | |
| DE | 102004026762 | | 2/2006 | |
| DE | 102005032113 | | 2/2007 | |
| DE | 102007039096 | | 2/2009 | |
| JP | 56-6731 | * | 1/1981 | B21D 5/01 |
| JP | 58-68431 | * | 4/1983 | B21D 19/08 |
| JP | 60-68115 | * | 4/1985 | B21D 5/04 |
| JP | 2-142621 | * | 5/1990 | B21D 5/02 |
| JP | 6-154865 | * | 6/1994 | B21D 5/01 |

* cited by examiner

*Primary Examiner* — Edward Tolan
(74) *Attorney, Agent, or Firm* — Henry M Feiereisen LLC

(57) ABSTRACT

A method for hot-forming and hardening a sheet-metal component with flanges in a cooled forming tool and an apparatus for carrying out the method are disclosed. A heated sheet-metal blank is inserted in a forming tool having a hollow form, with the sheet-metal blank projecting over the hollow form in marginal regions. The sheet-metal component formed from the sheet-metal blank is hardening of in the hollow form. A first flange having an X-bending axis is formed in a first marginal region with an auxiliary tool, and a second flange having a Y-bending axis is formed in a second marginal region with the auxiliary tool. The auxiliary tool has a plurality of dies, and the X- and Y-bending axes are not collinear and may be orthogonal to each other. Bending axes with a substantially perpendicular mutual orientation can be produced simultaneously in a single forming step.

20 Claims, 3 Drawing Sheets

METHOD AND APPARATUS FOR FORMING FLANGES DURING HOT-FORMING

CROSS-REFERENCES TO RELATED APPLICATIONS

This application claims the priority of German Patent Application, Serial No. 10 2009 056 728.3-14, filed Dec. 4, 2009, pursuant to 35 U.S.C. 119(a)-(d), the content of which is incorporated herein by reference in its entirety as if fully set forth herein.

BACKGROUND OF THE INVENTION

The present invention relates to a method for hot-forming and hardening a sheet-metal component with flanges in a cooled forming tool, and to an apparatus for hot-forming and hardening a sheet-metal component with flanges, wherein the apparatus has a forming tool and at least one auxiliary tool.

The following discussion of related art is provided to assist the reader in understanding the advantages of the invention, and is not to be construed as an admission that this related art is prior art to this invention.

During hot-forming, a metal sheet is heated to a temperature above its recrystallization temperature, i.e., to about 850° C. to 1100° C., and subsequently hot-formed. When the forming tool, which consists of a die and a die-plate, is cooled, the workpiece can be hardened while still in the tool (press-hardening).

After hardening, additional cold-forming or material-removing machining can only be performed at high cost. However, another hot-forming has the disadvantage that the material is subjected to a new structural transformation, wherein the original strengths can no longer be attained.

DE 10 2007 039 096 A1 describes a method for hot-forming a sheet-metal blank, wherein the hot sheet-metal blank projects at least partially over a corresponding blank form in a marginal region, so that this marginal region does not come into contact with cooled parts of the tool when the drawing press tool is closed. The marginal region is then initially not so strongly cooled as to cause hardening. It therefore retains good formability. The marginal region is post-formed in a subsequent post-forming process step by relative movement between tool components and thereby comes into contact with cooled tool regions to promote hardening. Such post-forming is performed by moving either the die or the die-plate relative to additional stationary tool components, or additional tool components can be constructed to be movable for post-forming.

Disadvantageously, flanges with differently oriented bending axes cannot be formed. The prior art only discloses methods where two flanges with different bending axes can be produced with several forming steps which is quite complex. As a particular disadvantage, the workpiece may meanwhile cool down so that it can no longer be hardened.

An additional disadvantage, a coating may have been applied on the workpiece before the forming process. This coating can be damaged in a subsequent forming process or in a forming process having a time offset.

It would therefore be desirable and advantageous to address this problem and to obviate other prior art shortcomings by providing a hot-forming method for implementing a forming process of a sheet-metal blank, with simultaneous forming of marginal regions of the sheet-metal blank into weld flanges having bending axes oriented in different directions. It would also be desirable to provide an apparatus for performing a forming process for producing weld flanges with differently oriented bending axes.

SUMMARY OF THE INVENTION

According to one aspect of the present invention, a method for hot-forming and hardening a sheet-metal component with flanges in a cooled forming tool includes the steps of inserting a heated sheet-metal blank into the forming tool, wherein the forming tool has a hollow form and the sheet-metal blank projects over the hollow form in marginal regions, forming the sheet-metal blank into a sheet-metal component with the forming tool, press-hardening the sheet-metal component in the hollow form, producing at least one first flange by forming with an auxiliary tool a first marginal region on the sheet-metal component held in the hollow form, wherein an X-bending axis of the first flange is oriented at an angle of 90°±45° with respect to a stroke axis of the forming tool, and producing at least one second flange by forming with the auxiliary tool a second marginal region on the sheet-metal component held in the hollow form, wherein a Y-bending axis of the second flange is oriented at an angle of 0°±45° with respect to the stroke axis of the forming tool.

The sheet-metal blank is hereby preferably heated to a temperature of 900° C. to 1100° C. and is moved to the forming tool while still hot. The forming tool has, depending on the design, different die means. These die means may be, for example, a die and a die-plate. In the collapsed state of the forming tool, a hollow form is formed. When the forming tool is collapsed, the sheet-metal blank is formed into the sheet-metal component. At the same time, the sheet-metal component is secured at a fixed position by the hollow form. In the method of the invention, the sheet-metal blank projects over the hollow form in different marginal regions when the forming tool is closed.

The forming tool is preferably cooled, so that the sheet-metal component is hardened during and after the forming process through martensite formation while still in the forming tool (press-hardening). The projecting marginal regions are subjected to a not very rapid cooling process and hence to a not very rapid structural transformation. The marginal regions can then advantageously still be easily hot-formed during and shortly after the forming process of the sheet-metal component.

In the method of the invention, a first flange is produced by forming a first marginal region on the sheet-metal component held in the hollow form with an auxiliary tool, wherein an X-bending axis of the first flange is oriented at an angle of 90°±45°, in particular substantially perpendicular to a stroke axis of the forming tool. In the method of the invention, the auxiliary tool can be moved relative to the forming tool. A major bending axis for a first flange is here the X-bending axis. This X-bending axis has the characteristic feature that is oriented perpendicular to a stroke axis of the forming tool. The stroke axis of the forming tool extends in most applications vertically, i.e., from the ceiling to the floor.

In another method step, a second flange is produced by forming with the auxiliary tool a second marginal region on the sheet-metal component held in the hollow form, wherein a Y-bending axis of the second flange is oriented at an angle of 0°±45°, i.e., substantially parallel to the stroke axis of the forming tool.

This has the advantage that the weld flanges can be produced in different bending directions, simultaneously or consecutively within a short time, still during hot-forming. The flanges are produced, while the sheet-metal blank is still hot, by forming and thereafter cooled through contact with the forming tool and hence likewise hardened by structural changes (press-hardening). Post-treatment or a post-forming step is no longer necessary. The forming process then becomes very cost-effective, because the tool needs to be clamped only once, where the completely formed sheet-metal component is held and the weld flanges are also produced by forming either simultaneously or within a short time.

Advantageously, the orientation of the bending axes can be freely selected. In particular, with the method of the invention, bending axes with a substantially perpendicular mutual orientation can be produced simultaneously in a single forming step.

Exactly perpendicular bending axes are a special case of substantially perpendicular bending axes. The term "substantially" is hereby not to be understood "within the context of manufacturing tolerances", but includes in the context of the present invention a defined angular range of ±45° in relation to an exactly perpendicular orientation of the axes.

In one embodiment, with the method of the invention, flanges with combined X- and Y-bending axes can be produced in a single forming step. A weld flange can hence include two different bending axes. In particular, difficult geometries of a weld flange may require multiple forming steps.

In another advantageous embodiment of the method of the invention, the auxiliary tool is a multi-part die tool. This has the advantage that the individual dies can be associated with different bending axes or weld flanges. Within the context of the invention, the term die refers to a die tool for pressing, stamping or similar forming processes. The auxiliary die is a smaller and hence more compact tool than the forming tool. The auxiliary tool can be moved in relation to the forming tool, thereby creating additional peripheral degrees of freedom.

In a preferred embodiment of the method of the invention, the flanges with an X-bending axis are pre-bent by the forming tool about the X-bending axis. The projecting marginal regions of the sheet-metal blank are pre-bent by the descending forming tool. The pre-bent portion of the marginal region is then further formed by the auxiliary tool to attain its end position. As a result, only linear movements are required for both tools. In one embodiment, a first die is used for producing the flanges with the X-bending axis.

In one embodiment, during the forming process of the flanges with X-bending axis, the flanges with a Y-bending axis are also pre-bent by the first die about the Y-bending axis. Advantageously, a second die can then be used to produce flanges with a Y-bending axis. The process for producing the flange is similar to the aforedescribed process.

In one embodiment, the first and second dies are coupled by an element having relative movement. This movable element operates preferably as a springy element. It can also be an air spring, a mechanical spring or any combination of the aforedescribed types of springs. The movable element for coupling the two dies necessitates only a single drive for the auxiliary tool. For producing at least two flanges with different bending directions, a tool with two dies is used, which requires only a single drive and can therefore be easily controlled.

In one embodiment, in the method of the invention, the auxiliary tool is driven by a mechanical, hydraulic or pneumatic actuator, depending on the application and the forming force to be generated.

In another advantageous embodiment of the method of the invention, the first and second die of the auxiliary tool can be moved separately, i.e., independent of each other. For example, a first flange can be produced within a rather short time by a first die, whereas the bending process for the second flange can be performed with a second die, if necessary more slowly and with a longer forming time.

In one embodiment, the formed flanges contact the forming tool over an area, so that they cool down quickly and are hence quickly hardened.

In other advantages embodiment of the method of the invention, the sheet-metal blank can be coated before the forming process. The coating is not damaged when the flanges are hot-formed.

According to another aspect of the invention, an apparatus for hot-forming and hardening a sheet-metal component with flanges from a sheet-metal blank includes a cooled forming tool having a hollow form, wherein a heated sheet-metal blank is inserted in the forming tool so as to project over the hollow form in marginal regions and the sheet-metal component is formed with the forming tool and press hardened, and at least one auxiliary tool constructed as a multi-part die tool having a plurality of dies, wherein a first die of the plurality of dies is constructed to produce at least one first flange by forming a first marginal region on the sheet-metal component, with an X-bending axis of the at least one first flange being oriented at an angle of 90°±45° with respect to a stroke axis of the forming tool, and wherein a second die of the plurality of dies is constructed to produce at least one second flange by forming a second marginal region on the sheet-metal component, with a Y-bending axis of the at least one second flange being oriented at an angle of 0°±45° with respect to the stroke axis of the forming tool.

With the apparatus, a die can advantageously be associated with a bending axis in one-to-one correspondence. A die in the context of the present invention refers to a forming tool. In the apparatus of the invention, the dies can be moved to the sheet-metal component simultaneously or within a short time, while the component is still in the clamp for the workpiece. This reduces the manufacturing time, because the workpiece need not be inserted into a new tool.

In an advantageous embodiment of the present invention, the forming tool is constructed so as to have a least one projection, wherein the projection pre-bends the flanges with an X-bending axis. By pre-bending the flanges with the X-bending axis, the auxiliary tool must then only be moved in a linear direction so as to bend the already pre-bent flanges to attain their end position.

In one embodiment, a first die is constructed for forming the flanges with an X-bending axis. The flanges pre-bent with the forming tool are formed by the first die to attain their end position.

In another advantages embodiment of the present invention, the first die has at least one die projection, wherein the die projection pre-bends the flanges with a Y-bending axis. This results in the same advantage as described above with reference to the projection on the forming tool.

A second die is provided for forming flanges with a Y-bending axis. Like the first die, the second die can also be moved in a linear direction so as to form the flanges with the Y-bending axis to attain their end position.

In one embodiment, the first and the second dies are coupled by an element having relative movement. This has the advantage that both dies can perform mutually different movements with a single drive motion. For example, the first die can engage, while the second die only performs a relative movement when the first die makes contact, for example, with the forming tool. The relative movement of the second die then causes formation of the flange with the Y-bending axis.

In an advantageous embodiment of the present invention, the movable element is embodied as a spring. Mechanical or pneumatic springs can be used. The movable element can also be implemented as a mixed type of known spring types, or can be moved relative to each other with a hydraulic, mechanical or pneumatic auxiliary actuator.

In one embodiment, the entire auxiliary tool can be moved or driven with a mechanical, hydraulic or pneumatic actuator. Advantageously, a suitable actuator can be selected commensurate with the application. A mechanical actuator may be, for example, implemented as an electromechanical actuator in form of a spindle drive.

According to another advantageous embodiment of the present invention, the first and the second dies of the auxiliary tool can be moved separately and designed for the respective forming requirements.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
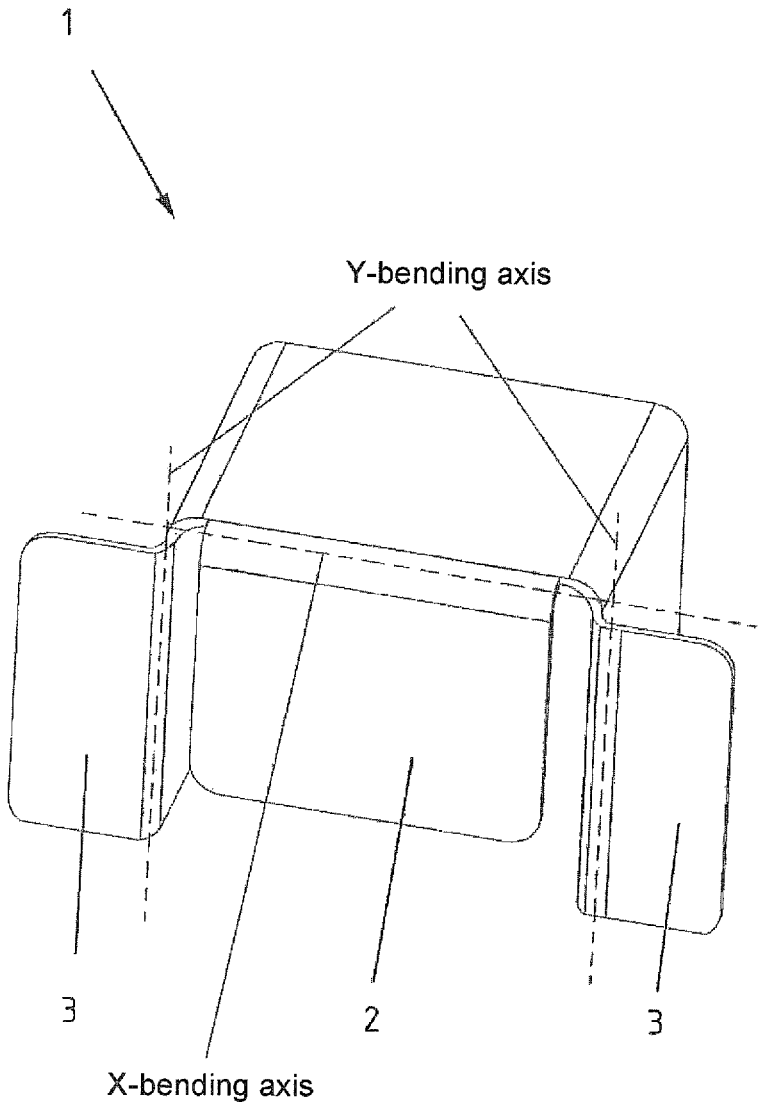
FIG. 1 shows an end section of a sheet-metal component produced with the method of the invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown an end section of a sheet-metal component 1 produced with the method of the invention. The sheet-metal component 1 has flanges 2, 3. The flanges are configured as weld flanges for a T-joint welding process. Preferably, the flanges have a 90° angle relative to a corresponding adjacent section of the sheet-metal component having a U-shaped cross-section. The center flange 2 is bent about an X-bending axis. The two other flanges 3 are each bent in opposite directions about a Y-bending axis.

Figure 2:
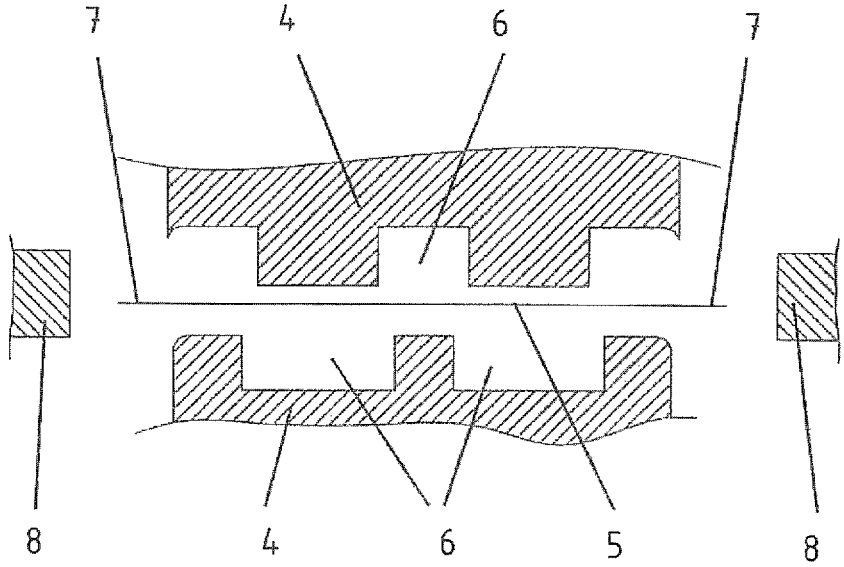
FIG. 2 shows in cross-section, a schematic diagram of a forming tool according to the invention with auxiliary tools in an open state.

FIG. 2 shows a forming tool 4 with a sheet-metal blank 5 which is inserted into a hollow form 6. The forming tool 4 is here illustrated schematically in cross-section. The hollow form 6 is produced by closing the forming tool 4. The hollow form 6 forms the sheet-metal blank 5 into the sheet-metal component 1. As can be seen, the sheet-metal blank 5 projects over the hollow form 6 in marginal regions 7. These marginal regions 7 then form the later flanges 2, 3. To form the flanges 2, 3, the marginal regions 7 are formed with auxiliary tools 8. The auxiliary tools 8 are preferably constructed as die tools.

Figure 3:
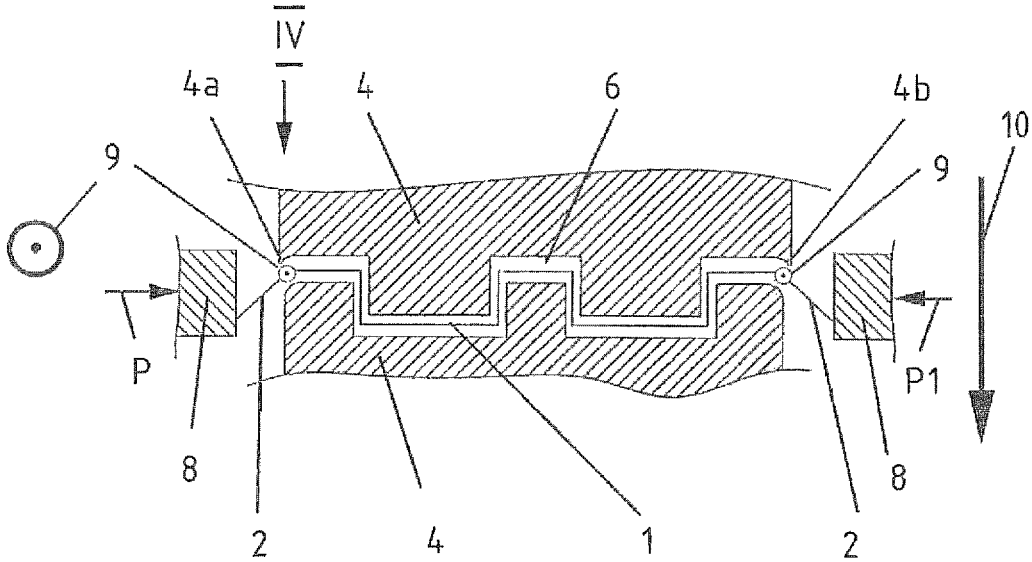
FIG. 3 shows in cross-section, a schematic diagram of a forming tool according to the invention with auxiliary tools in a closed state.

FIG. 3 shows the forming tool 4 in a closed state. As can be clearly seen, the sheet-metal blank 5 projects in its marginal regions 7 over the hollow form 6 formed between the forming tool 4. The marginal regions 7 are pre-bent by the projections 4*a*, 4*b* of the forming tool 4 about an X-bending axis 9. The X-bending axis 9 is oriented substantially perpendicular to a stroke axis 10 of the forming tool. After the flanges 2 with the X-bending axis 9 are pre-bent by the projections 4*a*, 4*b*, the auxiliary tool 8 engages. The auxiliary tool 8 forms the flanges 2 with the X-bending axis 9 so that they come in a preferred embodiment into contact with the forming tool 4. For this purpose, the auxiliary tools 8 are each moved in the respective directions of the arrows P, P1.

Figure 4:
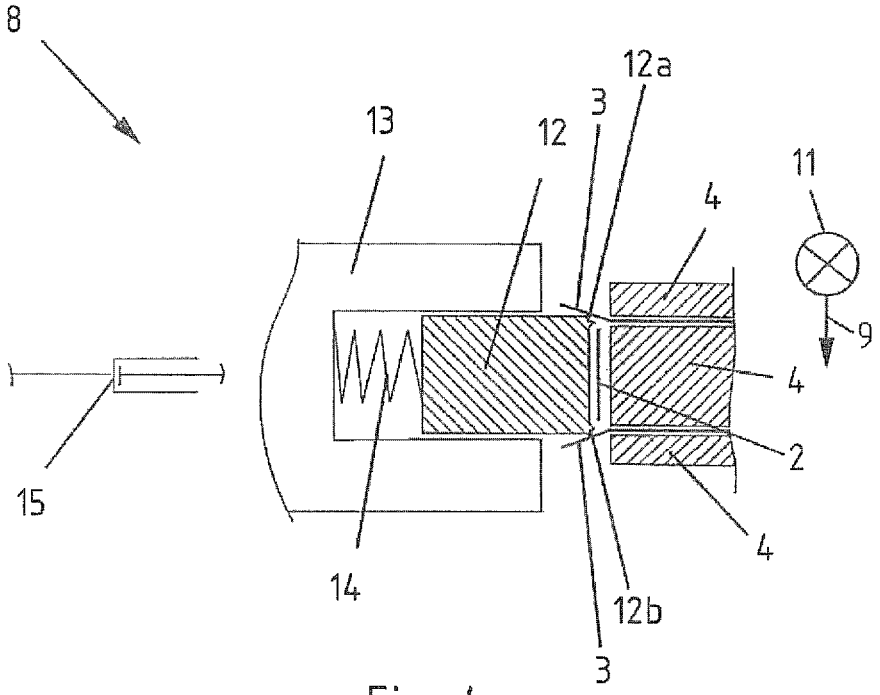
FIG. 4 shows in a cross-sectional top view, a schematic diagram of an auxiliary tool with two dies in engagement.

FIG. 4 shows a top view of the auxiliary tool 8 in engagement with the same viewing direction IV as FIG. 3. As can be seen, the flanges 3 with the Y-bending axis 11 were preformed by the first die 12. The forming process occurs here analogous to the pre-forming process of the flanges 2 with the X-bending axis 9. The first die 12 has die projections 12*a*, 12*b*. These die projections pre-form the flanges 3 with the Y-bending axis 11, while simultaneously forming the flange 2 with the X-bending axis 9. When the first flange 2 has been formed, the first die 12 makes contact, because the flange 2 makes contact with the forming tool 4 and the die 12 makes contact with the flange 2. Thereafter, during further movement of the auxiliary tool 8, a relative movement between the first die 12 and a second die 13 occurs. The two dies 12, 13 are coupled with each other via a movable element 14. The movable element is preferably implemented so as to be springy. The movable element 14 ensures that the first die 12 and the second die 13 move parallel to each other in a linear direction until the first die 12 makes contact. An actuator 15 is used for moving the first and the second dies 12, 13.

Figure 5:
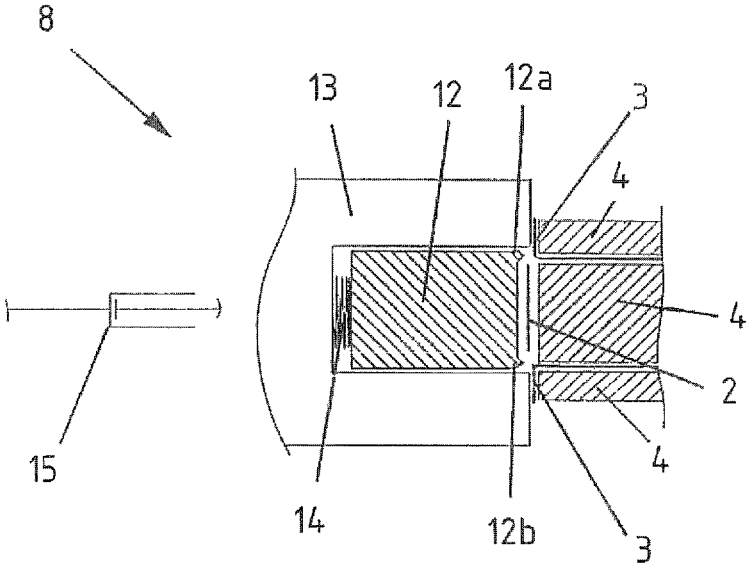
FIG. 5 shows in a cross-sectional top view, a schematic diagram of an auxiliary tool with two dies in the end position.

FIG. 5 shows the auxiliary tool 8 according to the invention in its end position. The flange 2 was bent with the first die 12 about the X-bending axis 9 until making contact with the forming tool 4, whereas the flanges 3 were bent with the second die 13 about the Y-bending axis 11 until making contact with the forming tool 4. The first die 12 and the second die 13 have reached their respective end positions when contacting the flanges 2, 3. The relative movement between the dies was performed by moving the auxiliary tool 8 and through contact of the first die 12 on the forming tool 4 in conjunction with the movable element 14. The movable element 14 was at least partially upset in the end position of both dies.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein.

What is claimed is:

1. A method for hot-forming and hardening a sheet-metal component with flanges in a cooled forming tool, comprising the steps of:

inserting a heated sheet-metal blank into the forming tool, wherein the forming tool has a hollow form and the sheet-metal blank projects over the hollow form in marginal regions, forming the sheet-metal blank into a sheet-metal component with the forming tool, press-hardening the sheet-metal component in the hollow form, producing at least one first flange by forming with an auxiliary tool a first marginal region on the sheet-metal component held in the hollow form, wherein an X-bending axis of the first flange is oriented at an angle of 90°±45° with respect to a stroke axis of the forming tool, and producing at least one second flange by forming with the auxiliary tool a second marginal region on the sheet-metal component held in the hollow form, wherein a Y-bending axis of the second flange is oriented at an angle of 0°±45° with respect to the stroke axis of the forming tool, wherein the at least one first flange with the X- bending axis and the at least one second flange with the Y-bending axis are produced in a single forming step.

2. The method of claim 1, wherein the auxiliary tool is constructed as a multipart die tool.

3. The method of claim 1, wherein the flanges are formed at the same time as the sheet-metal components are hot-formed or are formed after the sheet-metal components are hot-formed.

4. The method of claim 1, wherein the at least one first flange with the X-bending axis is pre-bent by the forming tool about the X-bending axis.

5. The method of claim 2, wherein at least one first flange with the X-bending axis is a produced with a first die of the auxiliary tool.

6. The method of claim 5, wherein the at least one second flange with the Y-bending axis is pre-bent by the first die about the Y-bending axis.

7. The method of claim 5, wherein at least one second flange with the Y-bending axis is a produced with a second die of the auxiliary tool.

8. The method of claim 7, wherein the first die and the second die are coupled with each other via an element having a relative movement.

9. The method of claim 8, wherein the movable element has a springy characteristic.

10. The method of claim 8, wherein first die and the second die are moved independent of each other.

11. The method of claim 1, wherein the at least one first flange and the at least one second flange are hardened through contact with the forming tool.

12. The method of claim 1, wherein the sheet-metal component is coated before being formed.

13. An apparatus for hot-forming and hardening a sheet-metal component with flanges from a sheet-metal blank, comprising:

a cooled forming tool having a hollow form, wherein a heated sheet-metal blank is inserted in the forming tool so as to project over the hollow form in marginal regions and the sheet-metal component is formed with the forming tool and press hardened, and at least one auxiliary tool constructed as a multi-part die tool having a plurality of dies, wherein a first die of the plurality of dies is constructed to produce at least one first flange by forming a first marginal region on the sheet-metal component, with an X-bending axis of the at least one first flange being oriented at an angle of 90°±45° with respect to a stroke axis of the forming tool, and wherein a second die of the plurality of dies is constructed to produce at least one second flange by forming a second marginal region on the sheet-metal component, with a Y-bending axis of the at least one second flange being oriented at an angle of 0°±45° with respect to the stroke axis of the forming tool.

14. The apparatus of claim 13, wherein the forming tool comprises a projection which is constructed to pre-bend the at least one first flange with an X-bending axis.

15. The apparatus of claim 13, wherein the first die is constructed for forming flanges with an X-bending axis.

16. The apparatus of claim 13, wherein the first die has at least one die projection which pre-bends the flanges with a Y-bending axis.

17. The apparatus of claim 13, wherein the second die is constructed for forming flanges with a Y-bending axis.

18. The apparatus of claim 13, wherein the first and the second dies are coupled by an element having relative movement.

19. The apparatus of claim 18, wherein the movable element is constructed as a spring.

20. The apparatus of claim 18, wherein the first and the second dies of the auxiliary tool are movable independent of each other.

* * * * *